US007021251B2

(12) United States Patent
Ohmori et al.

(10) Patent No.: US 7,021,251 B2
(45) Date of Patent: Apr. 4, 2006

(54) COMBUSTION TYPE POWER TOOL HAVING AVOIDING UNIT FOR AVOIDING OVERHEATING TO MECHANICAL COMPONENTS IN THE TOOL

(75) Inventors: Yasuki Ohmori, Hitachinaka (JP); Yasuo Sasaki, Hitachinaka (JP); Haruhisa Fujisawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/788,387

(22) Filed: Mar. 1, 2004

(65) Prior Publication Data

US 2004/0182336 A1 Sep. 23, 2004

(30) Foreign Application Priority Data

Mar. 19, 2003 (JP) ..... P2003-075338
Apr. 18, 2003 (JP) ..... P2003-114010
Nov. 28, 2003 (JP) ..... P2003-398611

(51) Int. Cl.
*F02B 71/00* (2006.01)

(52) U.S. Cl. ..... 123/46 R

(58) Field of Classification Search ..... 227/8, 227/130, 10; 123/46 SC, 46 R
See application file for complete search history.

(56) References Cited

U.S. PATENT DOCUMENTS 4,252,162 A 2/1981 Le Devehat
4,403,722 A 9/1983 Nikolich
4,483,473 A 11/1984 Wagdy
4,522,162 A 6/1985 Nikolich
RE32,452 E 7/1987 Nikolich
6,123,241 A 9/2000 Walter et al.
6,783,045 B1 * 8/2004 Shima et al. ..... 227/8

FOREIGN PATENT DOCUMENTS

EP 0 857 546 A1 8/1998

* cited by examiner

*Primary Examiner*—Henry C. Yuen
*Assistant Examiner*—Hyder Ali
(74) *Attorney, Agent, or Firm*—Antonelli, Terry, Stout and Kraus, LLP

(57) ABSTRACT

A combustion type power tool capable of avoiding damage to seal members and a housing to prolong a service life, and capable of enhancing operability and workability. Temperature elevation of a combustion chamber frame due to combustion of a mixture of combustible gas and air is detected by a temperature sensor disposed in a housing. If the detected temperature exceeds a preset temperature, ignition of an ignition plug is prohibited by a prohibiting unit in spite of ON operation of a trigger switch. In this state, alarming is performed by a display to notify the user of the inoperable state of the tool. Similar control can be made when the temperature sensor is disposed at a cylinder, an exhaust cover and the housing.

20 Claims, 10 Drawing Sheets

HEAD SWITCH 16 (PRESSING TOOL)
TRIGGER SWITCH 6
FAN 14
FAN TIMER 44
IGNITION PLUG 15
PISTON 25
COMBUSTION CHAMBER 26
TEMPERATURE ALARM DISPLAY 36
ON
OFF
DISPLACE
INITIAL POSITION
CLOSE
OPEN
t1 t2 t3 t4 t5 t6
t11 t12 t13 t14 t15 t16

HEAD SWITCH 16 (PRESSING TOOL)
TRIGGER SWITCH 6
FAN 14
FAN TIMER 444
IGNITION PLUG 15
PISTON 25
COMBUSTION CHAMBER 26
TEMPERATURE SENSOR 429
ON
OFF
DISPLACE
INITIAL POSITION
CLOSE
OPEN
H
L
T1 T2
T3 T4
T5
T6 T10
T11 T12 T13 T14 T15
T16
T17

COMBUSTION TYPE POWER TOOL HAVING AVOIDING UNIT FOR AVOIDING OVERHEATING TO MECHANICAL COMPONENTS IN THE TOOL

BACKGROUND OF THE INVENTION

The present invention relates to a combustion-type power tool, and more particularly, to a combustion-type fastener driving tool in which liquidized gas is ejected from a gas canister into a combustion chamber, mixed with air and ignited to drive a piston, thus generating power to drive nails or the like.

A conventional combustion-type driving tool generally includes a housing, a handle, a trigger switch, a head cap, a combustion-chamber frame, a push lever, a cylinder, a piston, a driver blade, a motor, a fan, a gas canister, an ignition plug, an exhaust-gas check valve, an exhaust cover, a magazine, and a tail cover. The head cap closes one end of the housing and is formed with a combustible gas passage. The handle is fixed to the housing and is provided with the trigger switch. The combustion-chamber frame is movable in the housing in the lengthwise direction thereof. The combustion-chamber frame is urged in a direction away from the head cap by a spring, and one end of the combustion-chamber frame is abuttble on the head cap against the biasing force of the spring.

The push lever is movably provided at the other end of the housing and is coupled to the combustion-chamber frame. The cylinder is secured to the housing and in communication with the combustion-chamber frame. The cylinder guides the movement of the combustion-chamber frame and is formed with an exhaust port. The piston is reciprocally movable in the cylinder. While the combustion-chamber frame has its one end abutting on the head cap, the piston defines a combustion chamber in cooperation with the head cap, the combustion-chamber frame and the end portion of the cylinder, the end portion being positioned near the head cap. The driver blade extends from the end of the piston which faces away from the combustion chamber toward the other end of the housing.

The motor is supported on the head cap. The fan is fastened to the motor and provided in the combustion chamber. The fan mixes the combustible gas with air in the combustion chamber for promoting combustion. The fan also serves to introduce an external air into the housing when the combustion-chamber frame is moved away from the head cap for scavenging within the combustion-chamber frame, and at the same time serves to cool an outer peripheral side of the cylinder. The gas canister is assembleable in the housing and contains liquidized combustible gas that is to be ejected into the combustion chamber through a combustible gas passage formed in the head cap. The ignition plug is faced to the combustion chamber to ignite a mixture of combustible gas and air. The exhaust-gas check valve selectively closes the exhaust port. The exhaust cover covers the exhaust gas check valve for directing the exhaust gas in the axial direction of the tool.

The magazine is positioned at the other end of the housing and contains fastening elements such as nails. The tail cover is interposed between the magazine and the push lever to supply the fastener from the magazine to a position of a moving locus of the driver bit.

In order to provide a hermetic state of the combustion chamber when the combustion chamber frame is brought into abutment with the head cap, a seal member (seal ring) is provided at a predetermined position of the head cap for intimate contact with an upper portion of the combustion-chamber frame and another seal member (seal ring) is provided at the cylinder near the head cap for intimate contact with a lower portion of the combustion chamber frame.

Upon ON operation of the trigger switch while the push lever is pushed against a workpiece, combustible gas is ejected into the combustion chamber from the gas canister assembled in the housing. In the combustion chamber, the combustible gas and air are stirred and mixed together by the fan. The ignition plug ignites the resultant mixture gas. The mixture gas explodes to drive piston for driving the driver blade, which in turn drives nails into a workpiece such as a wood block. After explosion, the combustion chamber frame is maintained in its abutting position to the head cap for a predetermined period of time. During this abutting period, the exhaust gas check valve is closed after the combustion gas is exhausted to maintain closing state of the combustion chamber. Further, thermal vacuum is generated in the combustion chamber due to pressure drop caused by decrease in temperature. Therefore, the piston can be moved toward its upper dead center because of the pressure difference between upper and lower spaces of the cylinder with respect to the piston. Such conventional power tool is described in for example, U.S. Pat. Nos. 4,522,162, 4,403,722, 4,483,473 and Re 32,452.

In the above-described conventional combustion type driving tool, generally, the cylinder, the combustion chamber frame, head cap those constituting the combustion chamber and a fan disposed therein are made from aluminum material, whereas the seal members such as O-rings are made from rubber and the housing is made from a plastic material. In this case, if the nail driving operation is repeatedly performed at a relatively short time interval, temperature of the combustion chamber frame and the cylinder are gradually elevated due to the heat absorption therein exceeding the cooling performance of the fan which generates cooling air in the combustion chamber frame and along the outer peripheral surface of the cylinder at the time of scavenging. This ultimately causes overheating. Therefore, cooling efficiency to the residual combustion gas in the combustion chamber is lowered, which affects generation of sufficient thermal vacuum. Consequently, return movement of the piston after nail driving is retarded, which lowers a sequential operation cycle thus degrading driving efficiency.

If nail driving operation is further continued in this overheating state, the housing and the handle those positioned adjacent to the combustion chamber frame and the cylinder are also heated. This heats the user's hand grasping the handle, to further degrade the operability. Finally, the excessive heat damages to the seal members which have been hermetically sealed the combustion chamber, because the seal members are made from thermally low heat resistant material such as rubber to lower the sealability, which leads to constant air introduction into the combustion chamber. This prevents the combustible gas from being ignited. Thus, no nail driving operation is performed in spite of manipulation to the trigger switch. Further, the housing may be thermally deformed and damaged because the housing is made from the plastic material. If the housing and/or seal members are damaged, the tool must be subjected to overhauling so as to replace the housing and the seal members by new housing and new seal members.

Further, the excessive temperature elevation lowers driving energy. If additional fan is supplemented for enhancement of cooling performance, additional installation space is required. Therefore, a compact tool cannot be provided.

SUMMARY OF THE INVENTION

It is therefore, an object of the present invention to provide a compact combustion type power tool capable of preventing seal members and a housing from being damaged for prolonging service life of the power tool, and capable of enhancing working efficiency and operability.

To attain the above described object, the present invention provides a combustion-type power tool including a housing, a handle, a head section, a motor, a push lever, a cylinder, a piston, a combustion-chamber frame, a driver blade, seal portions, a fan, an ignition plug, an exhaust check valve, a temperature detecting unit, and an avoiding unit. The handle extends from the housing and is provided with a trigger switch. The head section closes one end of the housing and is formed with a combustible gas passage. The motor is attached to the head section. The push lever is provided to the lower side of the housing and is movable upon pushing onto a workpiece. The cylinder is secured to the inside of the housing and is formed with an exhaust hole. The piston is slidably disposed in the cylinder and is reciprocally movable in an axial direction of the cylinder. The combustion-chamber frame is provided in the housing and is guidedly movable along the cylinder. The combustion-chamber frame has one end abuttable on and separable from the head section in interlocking relation to the movement of the push lever. A combination of the head section, the cylinder, the piston and the combustion-chamber frame defines a combustion chamber. The driver blade extends from the piston toward a side opposite to the combustion chamber. The seal portions provide sealing relations between the combustion chamber frame and the head section and between the combustion chamber frame and the cylinder when the combustion chamber frame is brought into abutment with the head section. The fan is rotatably positioned in the combustion chamber and is connected to the motor. The ignition plug is exposed to the combustion chamber for igniting a mixture of air and the combustible gas in the combustion chamber in response to operation of one of the trigger switch and the head switch. The exhaust check valve selectively opens the exhaust hole. The combustible gas is supplied into the combustion chamber through the combustible gas passage, and is explodingly combusted upon ignition of the ignition plug for moving the piston. The temperature detecting unit detects a temperature associated with one of the housing and the handle. The avoiding unit avoids overheating to one of the housing, the handle, and components in the housing. The avoiding unit is connected to the temperature detecting unit for controlling operation of one of the ignition plug and the fan based on a temperature detected by the temperature detecting unit. Here, the term "overheating" implies heating temperature and heating duration that causes deformation or softening of the housing and/or seal portions, and excessive heating to the handle preventing user's gripping, and that maintains high temperature preventing generation of the thermal vacuum.

The avoiding unit includes prohibiting means that prohibits ignition of the ignition plug when the temperature detected by the temperature detecting unit exceeds a predetermined temperature. Since the temperature detecting unit is disposed, and since is provided prohibiting means that prohibits ignition of the ignition plug when the temperature detected by the temperature detecting unit exceeds a predetermined temperature, operation of the tool such as nail driving operation at an abnormally high temperature can be prohibited, and further temperature increase of the tool, i.e., overheating can be eliminated, while improving workability and operability.

Alternatively, the avoiding unit includes a cooling control unit that controls rotation of the motor when the temperature detected by the temperature detecting unit exceeds a predetermined temperature so as to rotate the fan until the temperature detected by the detecting unit becomes not more than the predetermined temperature. A temperature of a portion such as the cylinder and combustion chamber frame where a temperature of the combustion chamber is assumable is detected, and rotation of the motor is controlled by the cooling control unit for controlling rotation of the fan in such a manner that the rotation of the fan is continued until the temperature of the portion defining the combustion chamber becomes not more than the predetermined temperature. Therefore, damage to the seal members and housing due to abnormal temperature increase can be avoided, and workability and operability can be improved without lowering driving performance. Further, since the cooling control unit controls rotation of the fan only when immediate cooling is required, service life of the battery can be prolonged for saving cost in comparison with a case where the fan is always rotated so that the tool does not reach the abnormal temperature.

Preferably, the temperature detecting unit is disposed at the combustion chamber frame. Since the temperature detection unit is disposed at the combustion chamber frame, control is performed based on the temperature of the combustion chamber frame. Thus, the predetermined temperature is determined in view of eliminations of overheating and thermal deformation of the combustion chamber frame. Therefore, lowering of working efficiency due to overheating and the deformation can be prevented.

Alternatively, the temperature detecting unit is disposed at the cylinder. Since the temperature detection unit is disposed at the cylinder, control is performed based on the temperature of the cylinder. Thus, the predetermined temperature is determined in view of eliminations of overheating and thermal deformation of the cylinder. Therefore, lowering of working efficiency due to overheating and the deformation can be prevented.

Alternatively, one of the components in the housing includes an exhaust cover covering the exhaust check valve for changing a exhausting direction into an axial direction of the housing, the temperature detecting unit being disposed at the exhaust cover. Since the temperature detection unit is disposed at the exhaust cover, control is performed based on the temperature of the exhaust cover. The exhaust cover is directly exposed to the exhaust gas and becomes to have the highest temperature among components in the power tool. The control is performed based on the temperature of the exhaust cover, i.e., based on the temperature of the highest temperature component in the tool. Since temperature of the remaining components is lower than that of the exhaust cover, further temperature increase of the tool can be avoided, thereby improving working efficiency and operability.

Alternatively, the temperature detecting unit is disposed at a wall of the housing. Since the temperature detection unit is disposed at the wall of the housing, control is performed based on the temperature of the housing. Thus, the predetermined temperature is determined in view of eliminations of softening and distortion of the housing. Therefore, lowering of working efficiency due to the deformation can be prevented.

The combustion-type power tool further includes alarm means disposed at one of the housing and the handle for alarming that the temperature detected by the temperature detecting unit exceeds the predetermined temperature. Therefore, the user of the tool can provisionally recognize that the driving operation should not be performed. If the alarm is ended, the user can recognize the re-start of operation, thereby improving working efficiency and operability.

Preferably, the cooling control unit includes a fan rotation continuing unit that continues rotation of the fan until the temperature detected by the detecting unit becomes not more than the predetermined temperature. Since the cooling control unit continues rotation of the fan until the detected temperature becomes not more than the predetermined temperature, the cylinder and the combustion chamber frame can be rapidly cooled.

Alternatively, the cooling control unit includes a fan rotation speed controller that controls rotation speed of the fan to a first rotation speed when the temperature detected by the detecting unit is not more than the predetermined temperature, and to a second rotation speed higher than the first rotation speed when the temperature detected by the detecting unit exceeds the predetermined temperature. The fan rotation speed controller maintains the second rotation speed until the temperature detected by the detecting unit becomes not more than the predetermined temperature. Therefore, the cylinder and the combustion chamber frame can be rapidly cooled.

BRIEF DESCRIPTION OF THE DRAWINGS

In the drawings:

FIG. 3(*b*) is a timing chart for description of operational phases of the fan, the ignition plug, a piston, a combustion chamber, and the display in response to ON/OFF operation of a head switch and a trigger switch in the combustion type nail driver according to the first embodiment, and represents phases when the detected temperature exceeds the preset temperature;

FIG. 9(*b*) is a timing chart for description of operational phases of the fan, the ignition plug, a piston, a combustion chamber, a fan timer and a temperature sensor in response to ON/OFF operation of a head switch and a trigger switch in the combustion type nail driver according to the fifth embodiment, and represents phases when the detected temperature exceeds the preset temperature.

DETAILED DESCRIPTION OF THE PREFERRED EMBODIMENTS

Figure 1:
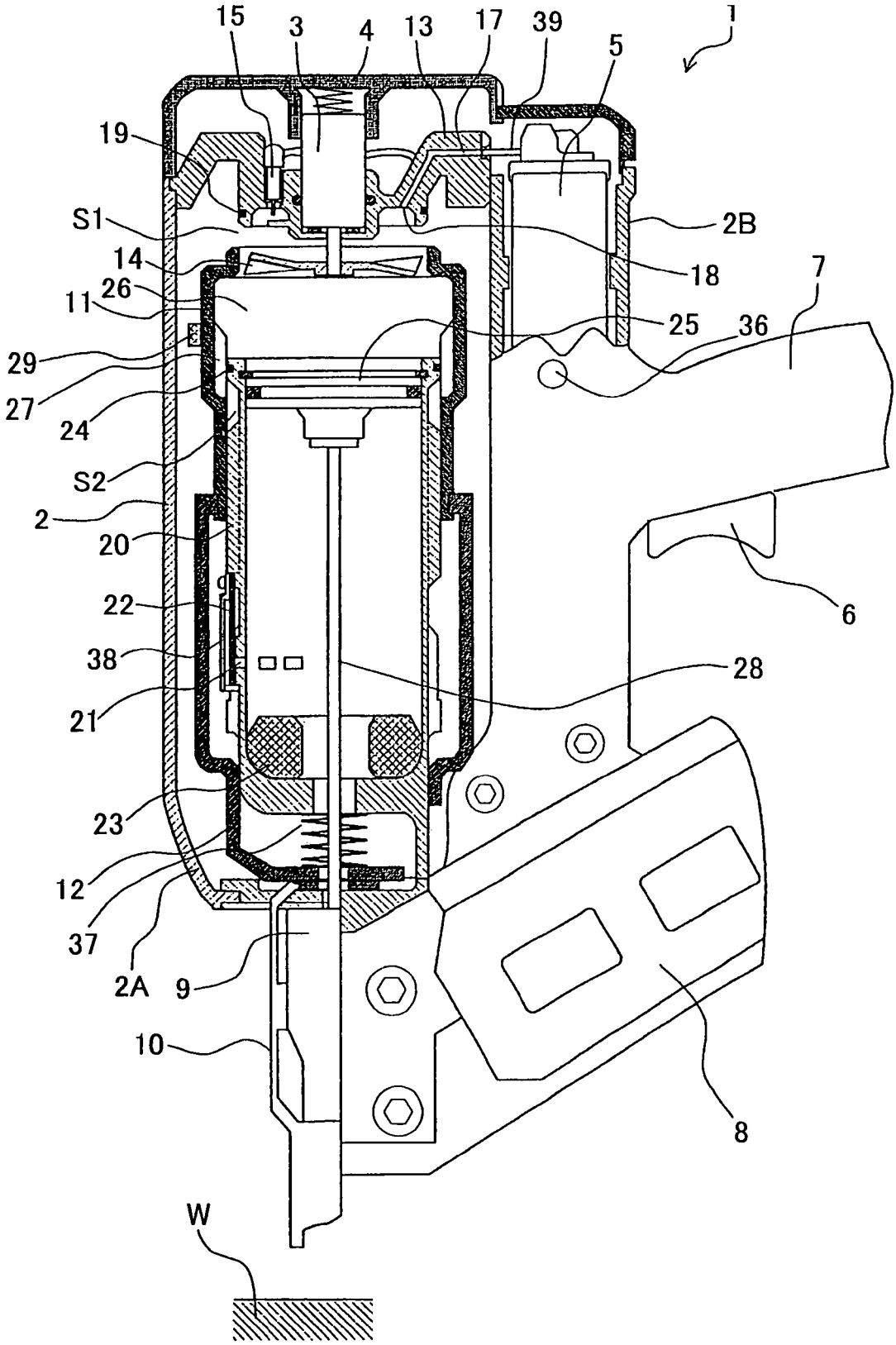
FIG. 1 is a vertical cross-sectional view showing a combustion type nail driver according to a first embodiment of a combustion type power tool of the present invention.

A combustion-type power tool according to a first embodiment of the present invention will be described with reference to FIGS. 1 through 3(*b*). The embodiment pertains to a combustion type nail driver. The combustion type nail driver 1 has a housing 2 constituting an outer frame and including a main housing 2A and a canister housing 2B juxtaposed to the main housing 2A. The main housing 2A has a top portion provided with a head cover 4 in which an intake port is formed, and has a bottom portion formed with an exhaust port (not shown).

A gas canister 5 containing therein a combustible gas is detachably disposed in the canister housing 2B. A handle 7 having a trigger switch 6 extends from the canister housing 2B. The handle 7 houses therein a battery for driving a motor 3 and an ignition plug 15 described later. A magazine 8 and a tail cover 9 are provided on the bottoms of the main housing 2A and canister housing 2B. The magazine 8 contains nails (not shown), and the tail cover 9 is adapted to guidingly feed each nail in the magazine 8 and set the nail to a predetermined position.

A push lever 10 is movably provided at the lower end of the main housing 2A and is positioned in conformance with a nail setting position defined by the tail cover 9. The push lever 10 is coupled to a coupling member 12 that is secured to a combustion-chamber frame 11 which will be described later. When the entire housing 2 is pressed toward a workpiece W while the push lever 10 is in abutment with the workpiece, an upper portion of the push lever 10 is retractable into the main housing 2A.

A head cap 13 is secured to the main housing 2A and at a position below the head cover 4. The head cap 13 supports the motor 3 having a motor shaft, and a fan 14 is coaxially fixed to the motor shaft. The head cap 13 also supports the ignition plug 15 ignitable upon manipulation to the trigger switch 6. A head switch 16 (FIG. 2) is provided in the main housing 2A for detecting an uppermost stroke end position of the combustion chamber frame 11 when the power tool is pressed against the workpiece W. Thus, the head switch 16 can be turned ON when the push lever 10 is elevated to a predetermined position for starting rotation of the motor 3, thereby starting rotation of the fan 14. A temperature sensor 29 such as a thermistor, a thermo-couple, and a bimetal is attached to a wall of the combustion chamber frame 11 for detecting a temperature of the combustion chamber frame 11.

The head cap 13 has a canister housing side in which is formed a fuel ejection passage 17 which allows a combustible gas to pass therethrough. One end of the ejection passage 17 serves as an ejection port 18 that opens at the lower surface of the head cap 13. Another end of the ejection passage 17 is communicated with a gas canister 5 which will be described later. A first seal member 19 such as an O-ring is installed in the head cap 13 for providing a seal between the head cap 13 and an upper end portion of the combustion-chamber frame 11 when the upper end of the combustion-chamber frame 11 abuts on the head cap 13.

The combustion-chamber frame 11 is provided in the main housing 2A and is movable in the lengthwise direction of the main housing 2A. The uppermost end of the combustion-chamber frame 11 is abuttable on the lower surface of the head cap 13. The coupling member 12 described above is secured to the lower end of the combustion-chamber frame 11 and is connected to the push lever 10. Therefore, the combustion chamber frame 11 is movable in interlocking relation to the push lever 10. A cylinder 20 is fixed to the main housing 2A. The inner circumference of the combustion-chamber frame 11 is in sliding contact with an outer peripheral surface of the cylinder for guiding the movement of the combustion-chamber frame 11. A compression coil spring 37 is interposed between the lower end of the cylinder 20 and the lower end of the coupling member 12 for biasing the combustion-chamber frame 11 in a direction away from the head cap 13. The cylinder 20 has a lower portion formed with an exhaust hole 21 in fluid communication with the above-mentioned exhaust port of the main housing 2A. An exhaust-gas check valve 22 is provided to selectively close the exhaust hole 21. Further, an exhaust cover 38 is attached to the cylinder 20 to surround the exhaust hole 21 so as to change the exhausting direction of the exhaust gas discharged through the exhaust hole 21 in the axial direction of the cylinder 20. A bumper 23 is provided on the bottom of the cylinder 20. A second seal member 24 such as an O-ring is provided on the upper portion of the cylinder 20 to provide a seal between the inner circumference of the lower part of the combustion-chamber frame 11 and the outer circumference of the upper part of the cylinder 20 when the combustion-chamber frame 11 abuts on the head cap 13.

A piston 25 is slidably and reciprocally provided in the cylinder 20. When the upper end of the combustion-chamber frame 11 abuts on the head cap 13, the head cap 13, the combustion-chamber frame 11, the upper portion of the cylinder 20, the piston 25 and the first and second seal members 19, 24 define in combustion a combustion chamber 26. When the combustion chamber frame 11 is separated from the head cap 13, a first flow passage S1 in communication with the atmosphere is provided between the head cap 13 and the upper end of the combustion chamber frame 11, and a second flow passage S2 in communication with the first flow passage S1 is provided between the lower end portion of the combustion chamber frame 11 and the upper end portion of the cylinder 20. The second flow passage S2 allows a combustion gas and a fresh air to pass along the outer peripheral surface of the cylinder 20 for discharging these gas through the exhaust port of the main housing 2A.

A plurality of ribs 27 are provided on the inner peripheral portion of the combustion-chamber frame 11 which portion defines the combustion chamber 26. The ribs 27 extend in the lengthwise direction of the combustion chamber frame 11 and project radially inwardly toward the axis of the main housing 2A. The ribs 27 cooperate with the fan 14 to promote the stirring and mixing of air with the combustible gas in the combustion chamber 26. The above-mentioned intake port (not shown) is adapted to supply air into the combustion chamber 26, and the exhaust hole 21 and the exhaust port are adapted to exhaust the combusted gas from the combustion chamber 26.

A driver blade 28 extends downwards from a side of the piston 25, the side being opposite to the combustion chamber 26 to the lower end of the main housing 2A. The driver blade 28 is positioned coaxially with the nail setting position in the tail cover 9, so that the driver blade 28 can strike against the nail. When the piston 25 moves downward, the piston 25 abuts on the bumper 23 and stops.

The fan 14 is provided in the combustion chamber 26, and the ignition plug 15 and the ejection port 18 are respectively exposed and open to the combustion chamber 26. Rotation of the fan 14 performs the following three functions. First, the fan 14 stirs and mixes the air with the combustible gas as long as the combustion-chamber frame 11 remains in abutment with the head cap 13. Second, after the mixed gas has been ignited, the fan 14 causes turbulence of the air-fuel mixture, thus promoting the combustion of the air-fuel mixture in the combustion chamber 26. Third, the fan 14 performs scavenging such that the exhaust gas in the combustion chamber 26 can be scavenged therefrom and also performs cooling to the combustion chamber frame 11 and the cylinder 20 when the combustion-chamber frame 11 moves away from the head cap 13 and when the first and second flow passages S1, S2 are provided.

A display 36 such as an LED is visibly provided at the canister housing 2B. The display 36 maintains non-lighting state indicative of operative state of the nail driver when the temperature of the combustion chamber frame 11 or the cylinder 20 is within a predetermined allowable temperature. The display 36 also maintains lighting or blinking state as an alarming purpose indicative of inoperative state of the nail driver when the temperature reaches an abnormal temperature. Incidentally, an upper limit of the allowable temperature is so determined that the temperature does not cause thermal deformation or damage to the seal members 19, 24 made from a rubber disposed nearby the combustion chamber frame 11, yet the temperature can create the thermal vacuum.

Figure 2:
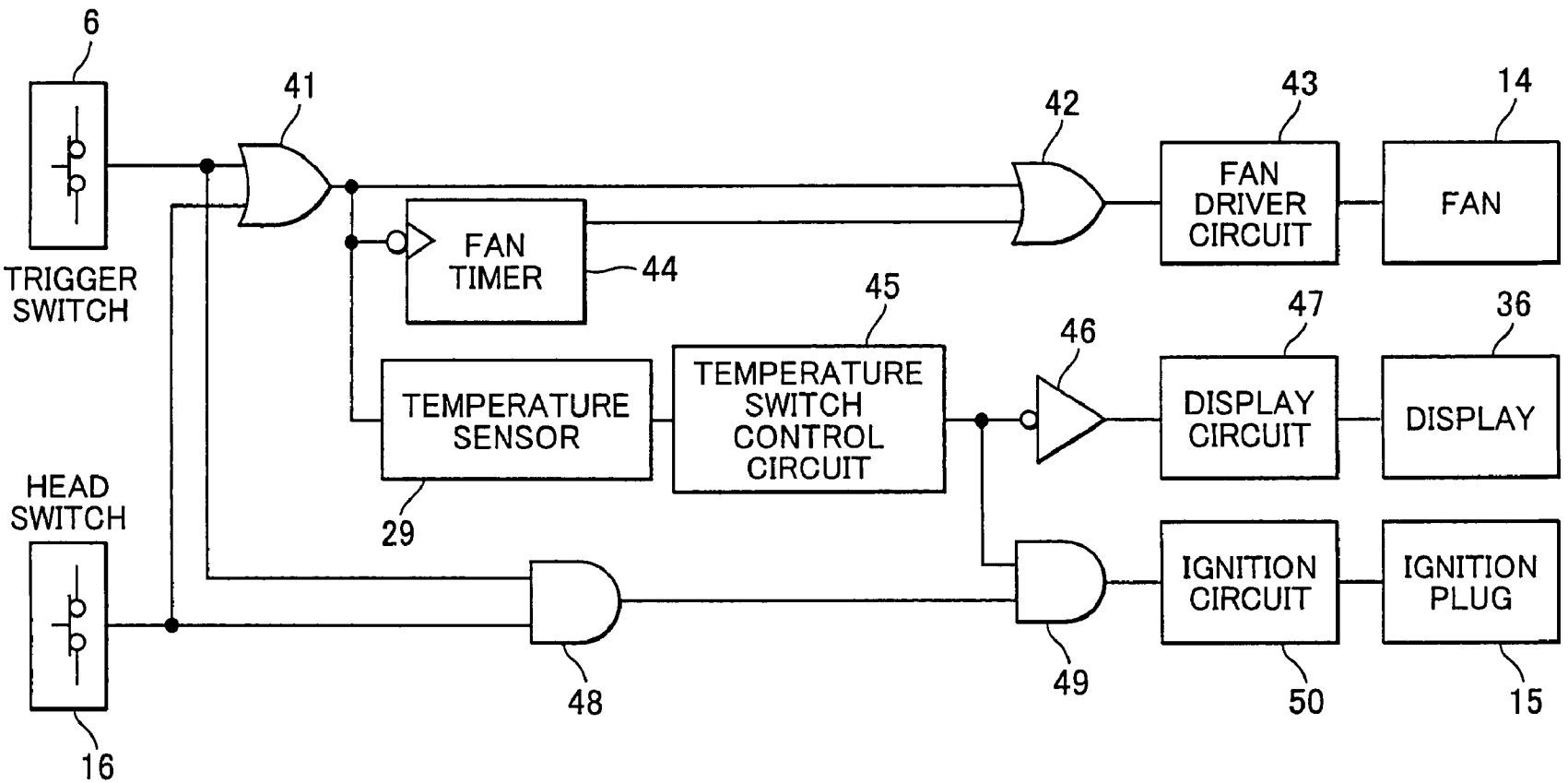
FIG. 2 is a block circuit diagram executing ON/OFF operation of a fan, a display and an ignition plug those being components of the combustion type nail driver according to the first embodiment.
Figures 3A, 3B:
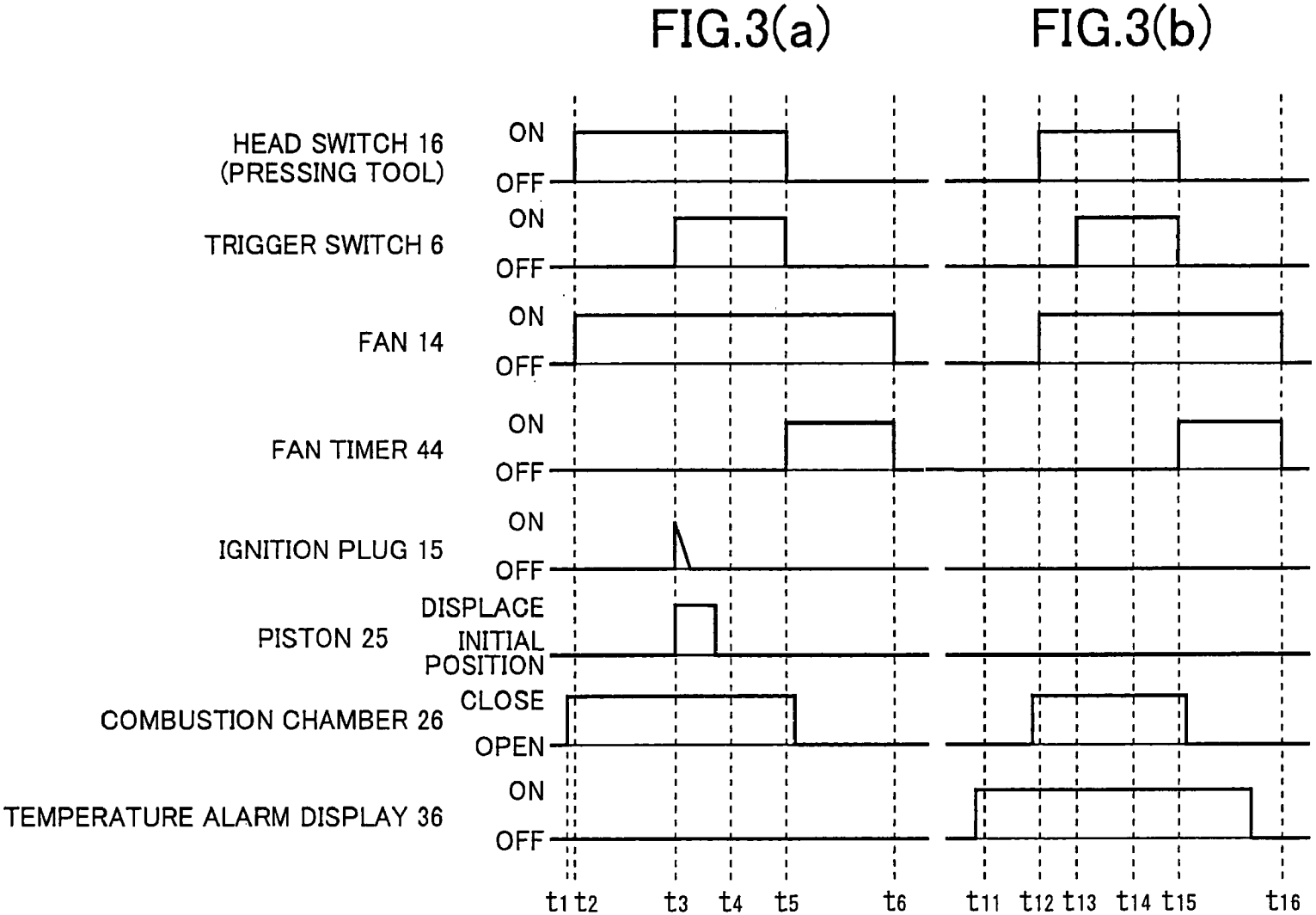
FIG. 3(*a*) is a timing chart for description of operational phases of the fan, the ignition plug, a piston, a combustion chamber, and the display in response to ON/OFF operation of a head switch and a trigger switch in the combustion type nail driver according to the first embodiment, and represents phases when temperature detected by a temperature sensor is not more than a preset temperature.

FIG. 2 shows a block circuit executing driving and non-driving to the fan 14, lighting and non-lighting to the display 36, and ignition or non-ignition to the ignition plug 15. A first OR circuit 41 has two input terminals one being connected to the trigger switch 6 and the other being connected to the head switch 16. The first OR circuit 41 has an output terminal connected to a first input terminal of a second OR circuit 42. The second OR circuit 42 has an output terminal connected to a fan driver circuit 43 connected to the fan 14. Therefore, the operation of the fan driver circuit 43 starts for starting rotation of the motor 3 thereby starting rotation of the fan 14 in response to ON operation of at least one of the trigger switch 6 and the head switch 16.

A fan timer 44 is connected between the output terminal of the first OR circuit 41 and a second input terminal of the second OR circuit 42. The fan timer 44 starts when the trigger switch 6 and the head switch 16 are turned OFF, and is adapted to stop rotation of the fan 14 after elapse of a predetermined time period from the timer start timing.

Therefore, rotation of the fan 14 continues after starting rotation thereof unless the trigger switch 6 and the head switch 16 are turned OFF.

The temperature sensor 29 is connected to the output terminal of the first OR circuit 41. Therefore, the temperature sensor 29 starts temperature detection in response to ON switching with respect to at least one of the trigger switch 6 and the head switch 16. A temperature switch control circuit 45 is connected to the temperature sensor 29. The temperature switch control circuit 45 is adapted to output H level signal if the temperature detected by the temperature sensor 29 is not more than the allowable temperature, and output L level signal if the detected temperature exceeds the allowable temperature. The temperature switch control circuit 45 is connected, through a NOT circuit 46, to a display circuit 47 connected to the display 36. Therefore, if the temperature switch control circuit 45 outputs H level signal, that is, if the temperature detected by the temperature sensor 29 is not more than the allowable temperature, L level signal is input into the display circuit 47 through the NOT circuit 46 to maintain inoperative state of the display circuit 47. Thus, the display 36 does not perform lighting or blinking. On the other hand, if the detected temperature exceeds the allowable temperature, L level signal is output from the temperature switch control circuit 45, so that the display circuit 47 receives H level signal through the NOT circuit 46 to start operation of the display circuit 47 whereupon the display 36 performs lighting or blinking. The display circuit 47 and the display 36 serve as an alarm unit.

A first AND circuit 48 has two input terminals one being connected to the trigger switch 6 and the other being connected to the head switch 16. A second AND circuit 49 has two input terminals one being connected to an output terminal of the first AND circuit 48, and the other being connected to the temperature switch control circuit 45. The second AND circuit 49 has an output terminal connected to an ignition circuit 50 connected to the ignition plug 15. With this arrangement, an operation command signal is output from the second AND circuit 49 to the ignition circuit 50 for igniting the ignition plug 15 only when the trigger switch 6 and the head switch 16 are rendered ON and H level signal is output from the temperature switch control circuit 45, i.e., the temperature detected by the temperature sensor 29 is not more than the allowable temperature. The second AND circuit 49 and the temperature switch control circuit 45 function as prohibiting unit which prohibit ignition in case of the abnormal temperature.

Operation of the combustion type driving tool 1 according to the first embodiment will next be described with reference to a timing chart shown in FIG. 3. In the non-operational state of the combustion type nail driver 1, the push lever 10 is biased downward by the biasing force of the compression coil spring 37, so that the push lever 10 protrudes from the lower end of the tail cover 9. Thus, the uppermost end of the combustion-chamber frame 11 is spaced away from the head cap 13 because the coupling member 12 couples the combustion-chamber frame 11 to the push lever 10. Further, a part of the combustion-chamber frame 11 which part defines the combustion chamber 26 is also spaced from the top portion of the cylinder 20. Hence, the first and second flow passages S1 and S2 are provided. In this condition, the piston 25 stays at the top dead center in the cylinder 20.

With this state, if the push lever 10 is pushed onto the workpiece W such as a wood block while holding the handle 7 by a user, the push lever 10 is moved upward against the biasing force of the compression coil spring 37. At the same time, the combustion-chamber frame 11 which is coupled to the push lever 10, is also moved upward, closing the above-described flow passages S1 and S2. Thus, the sealed combustion chamber 26 is provided by the seal members 19 and 24 (t1).

In accordance with the movement of the push lever 10, the gas canister 5 is tilted toward the head cap 13 by an action of a cam (not shown). Thus, the injection rod 39 is pressed against the connecting portion of the head cap 13. Therefore, the liquidized gas is ejected once into the combustion chamber 26 through the ejection port 18.

Further, in accordance with the movement of the push lever 10, the combustion chamber frame 11 reaches the uppermost stroke end whereupon the head switch 16 is turned ON (t2) to start rotation of the fan 14. Rotation of the fan 14 and the ribs 27 protruding into the combustion chamber 26 cooperate, stirring and mixing the combustible gas with air in the combustion chamber 26.

If the temperature detected by the temperature sensor 29 is not more than the allowable temperature, the ignition plug 15 generates a spark, which ignites the gas mixture upon turning ON the trigger switch 6 at the handle 7. At this time, the fan 14 keeps rotating, promoting the turbulent combustion of the gas mixture. This enhances the output of the power tool. The combusted and expanded gas pushes the piston 25 downward. Therefore, a nail in the tail cover 9 is driven into the workpiece through the driver blade 28 until the piston 25 abuts on the bumper 23.

As the piston 25 passes by the exhaust hole 21 of the cylinder 20, the check valve 22 opens the exhaust hole 21 because of the application of the combustion gas pressure to the check valve 22. Therefore the combustion gas is discharged from the cylinder 20 through the exhaust hole 21 and then discharged outside through the exhaust port of the main housing 2A. The check valve is closed when the pressure in the cylinder 20 and combustion chamber 26 is restored to the atmospheric pressure as a result of the discharge. Combustion gas still remaining in the cylinder 20 and the combustion chamber 26 has a high temperature at a phase immediately after the combustion. However, the high temperature can be absorbed into the walls of the cylinder 20 and the combustion-chamber frame 11 to rapidly cool the combustion gas. Thus, the pressure in the sealed space in the cylinder 20 above the piston 25 further drops to less than the atmospheric pressure (creating a so-called "thermal vacuum"). Accordingly, the piston 25 is moved back to the initial top dead center in the cylinder 20 by virtue of the pressure difference between the internal pressure in the combustion chamber 26 and the pressure in the lower part of the cylinder 20 lower than the piston 25.

In the present embodiment, in order to positively generate the thermal vacuum, the uppermost stroke end position of the combustion chamber frame 11 is maintained unchanged so as to avoid formation of the flow passages S1 and S2 in spite of the separation of the lower end of the push lever 10 from the workpiece due to reaction force inevitably accompanied by the nail driving operation. In the present embodiment, communication of the combustion chamber 26 with the atmosphere is prohibited as long as ON state of the trigger switch 6 is maintained.

Then, the user lifts the combustion type nail driver 1 from the workpiece for separating the push lever 10 from the workpiece, and turns off the trigger switch 6(t5). As a result, the push lever 10 and the combustion-chamber frame 11 move downward due to the biasing force of the compression coil spring 37. Therefore, the flow passages S1 and S2 are provided again. Since the fan keeps rotating, fresh air flows into the combustion chamber 26 through the intake port and through the flow passages S1, S2, expelling the residual gas through the exhaust port. Thus, the combustion chamber 26 is scavenged. Then, the combustion type nail driver 1 restores its initial state.

In accordance with the OFF operation of the trigger switch 6 and downward movement of the combustion chamber frame 11, the head switch 16 is turned OFF (t5), whereupon the fan timer 44 starts. Then, the rotation of the fan 14 is stopped after elapse of a predetermined time period starting from the start timing of the fan timer 44 (from t5 to t6). In other words, since the fan 14 keeps rotating for a predetermined time period after turning OFF the head switch in spite of turning OFF the trigger switch 6, fresh air can be introduced into the combustion chamber 26 through the intake port of the housing 2 and through the flow passages S1, S2, and combustion gas is discharged through the exhaust port of the housing to perform scavenging to the combustion chamber 26. Then, the rotation of the fan 14 is stopped (t6) to recover the initial rest position. Even after the repeated nail driving operations, the display 36 is not lighted or blinked, that is, the display 36 does not perform alarming as long as the temperature switch control circuit 45 outputs H level signal.

If the above-described nail driving operation is repeatedly performed, temperature of the combustion chamber frame 11 and the cylinder 20 are elevated. If the temperature of the combustion chamber frame exceeds the predetermined allowable temperature, operation timings t11 through t16 correspond respectively to the operation timings t1 through t6 regarding ON/OFF timing of the head switch 16, ON/OFF timing of the trigger switch 6, and opening/closing timing of the combustion chamber 26. On the other hand, since the temperature switch control circuit 45 outputs L level signal to the second AND circuit 49, the ignition circuit 50 maintains inoperative condition, preventing the ignition plug 15 from being ignited irrespective of ON timing of the trigger switch 6 (t13). Thus, displacement of the piston 25 does not occur. In this instance, cooling to the combustion chamber frame 11 and the cylinder 20 is only performed by the fan 14 rotated from the timing t12 to t16.

Further, in response to L level signal output from the temperature switch control circuit 45, the display 36 performs lighting or blinking by way of the NOT circuit 46 and the display circuit 47 so as to alarm inoperative state of the combustion type driving tool 1 due to ignition preventing phase. Consequently, use of the combustion type nail driver 1 is suspended for obtaining cooling period. If the temperature of the combustion chamber frame 11 becomes not more than the allowable temperature, lighting or blinking of the display 36 is terminated whereupon the user can recognize usable state of the tool 1 to restart the above-described nail driving operation. Incidentally, FIG. 3(*b*) shows a state after performing a number of nail driving operation, and therefore, the temperature alarming display has already been made prior to the timing of t11.

Figure 4:
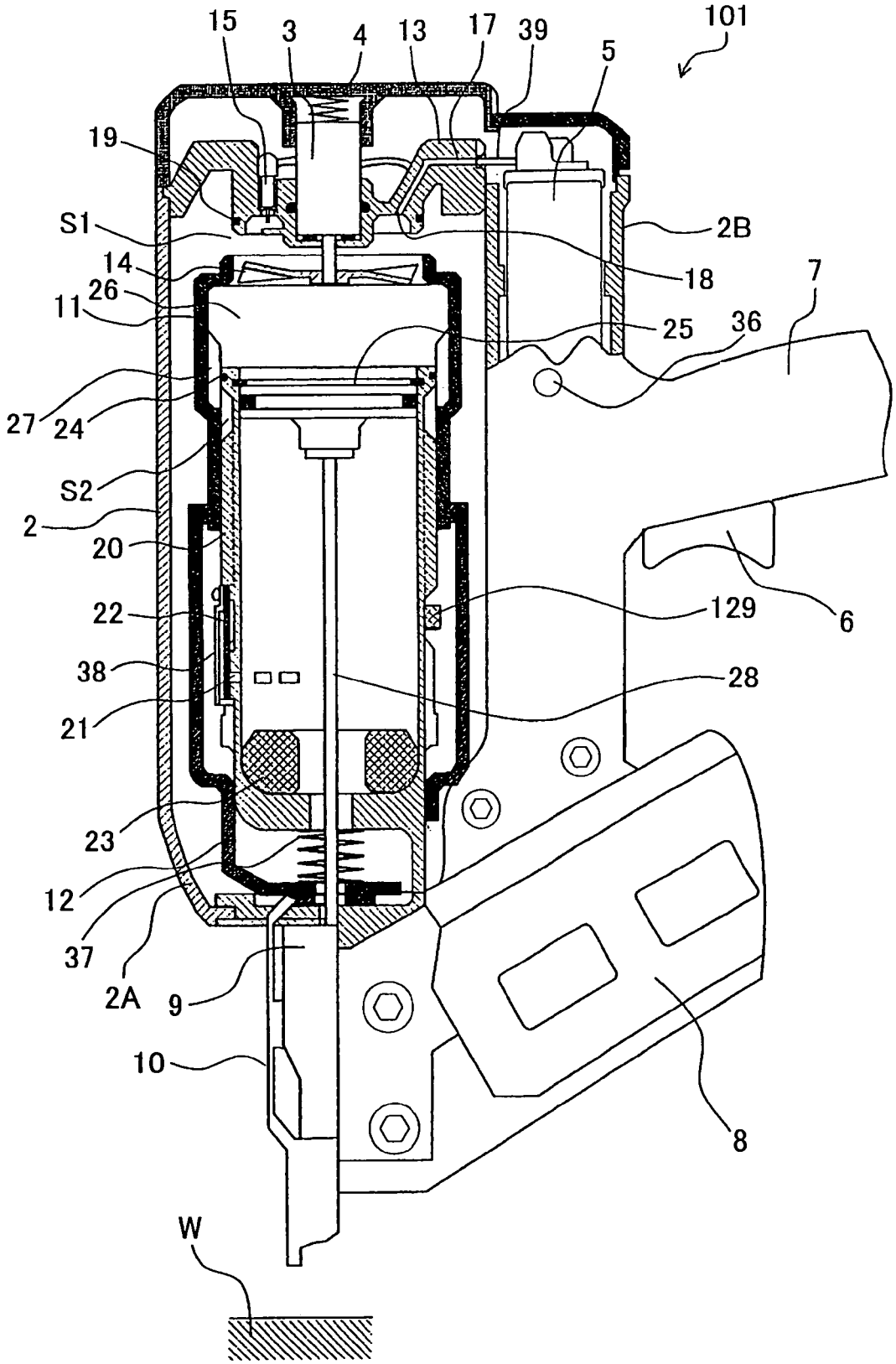
FIG. 4 is a vertical cross-sectional view showing a combustion type nail driver according to a second embodiment of a combustion type power tool of the present invention.

A combustion type nail driver which embodies a combustion type power tool and in accordance with a second embodiment will be described with reference to FIG. 4. As shown in FIG. 4, fundamental construction and function of a combustion type nail driver 101 according to the second embodiment are the same as those of the first embodiment, and therefore, duplicating description will be omitted.

In the nail driver 101, a temperature sensor 129 is provided at a cylinder 20 for detecting a wall temperature of the cylinder 20. Based on the temperature detection, nail driving operation of the nail driver 101 is controlled in a manner similar to the control made by the arrangement shown in FIG. 2.

Apparently, a predetermined allowable temperature is set as to the surface temperature of the cylinder 20. Similar to the first embodiment, the temperature switch control circuit 45 outputs H level signal if the temperature sensor 129 detects the temperature not more than the allowable temperature, and outputs L level signal if the temperature sensor 129 detects the temperature exceeding the allowable temperature.

The upper limit of the allowable temperature is determined on a basis of the thermal deformation and damage to the rubber seal members 19 and 24 and the bumper 23, and capability of providing a thermal vacuum.

Accordingly, the combustion type nail driver 101 can be used without being overheated and without lowering workability by way of the control similar to the first embodiment based on the output signal from the temperature sensor 129.

Figure 5:
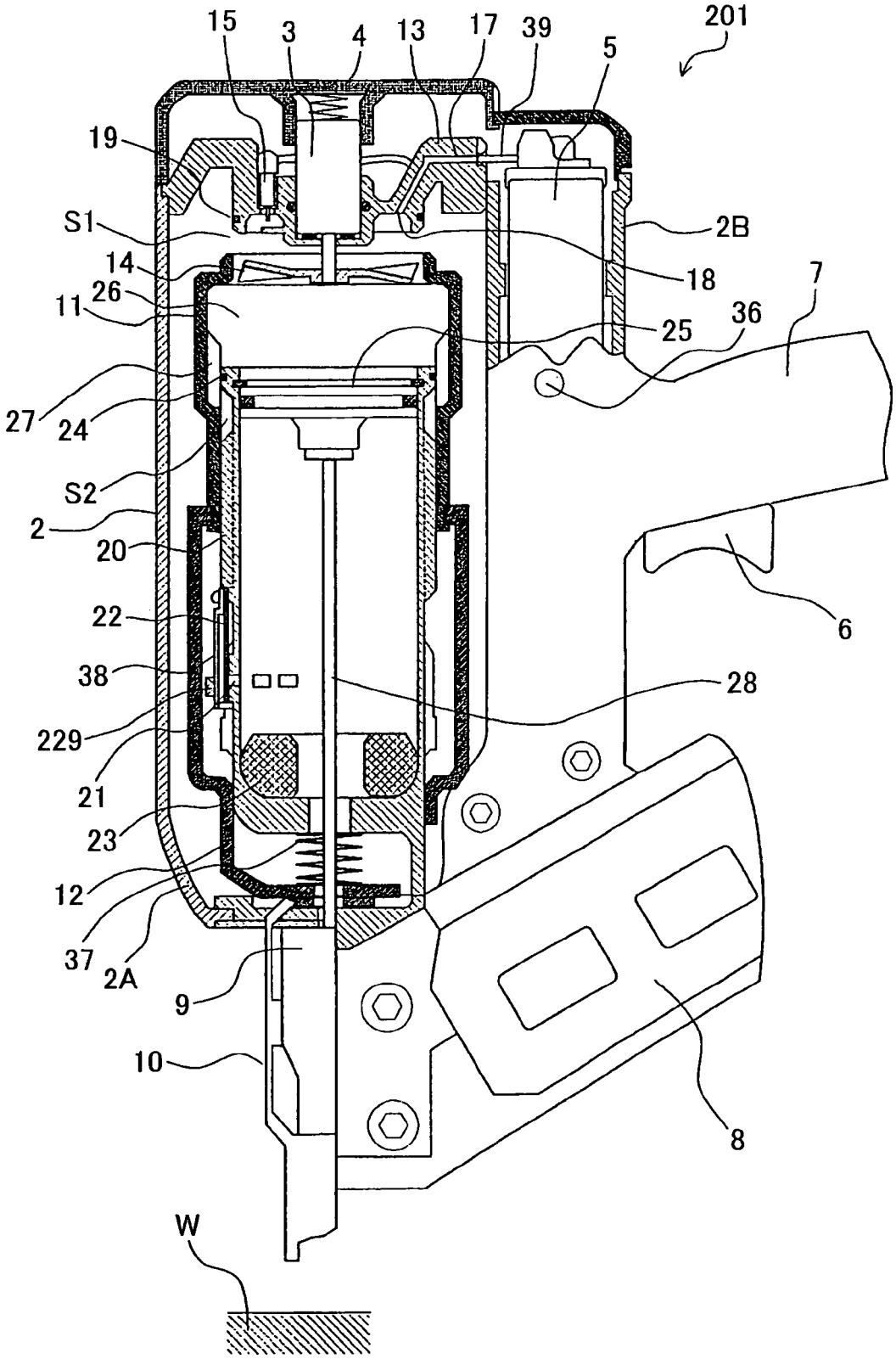
FIG. 5 is a vertical cross-sectional view showing a combustion type nail driver according to a third embodiment of a combustion type power tool of the present invention.

A combustion type nail driver according to a third embodiment will next be described with reference to FIG. 5. As shown in FIG. 5, fundamental construction and function of a combustion type nail driver 201 according to the third embodiment are the same as those of the first embodiment, and therefore, duplicating description will be omitted.

In the nail driver 201, a temperature sensor 229 is provided at an exhaust cover 38 for detecting a wall temperature thereof. Based on the temperature detection, nail driving operation of the nail driver 201 is controlled in a manner similar to the control made by the arrangement shown in FIG. 2. Apparently, a predetermined allowable temperature is set as to the surface temperature of the exhaust cover 38. Similar to the first embodiment, the temperature switch control circuit 45 outputs H level signal if the temperature sensor 229 detects the temperature not more than the allowable temperature, and outputs L level signal if the temperature sensor 229 detects the temperature exceeding the allowable temperature.

The exhaust cover 38 provides the highest temperature among various components in the combustion type nail driver 201. Therefore, temperature of the remaining components appears to be lower than that of the exhaust cover 38. Thus, the upper limit of the allowable temperature is determined on a basis of melting point and deforming temperature of the remaining components while detecting the temperature at the exhaust cover 38 so that the temperature switch control circuit can generate L level signal when the detected temperature exceeds the allowable temperature. Thus, combustion can be controlled in a manner similar to the first embodiment.

Figure 6:
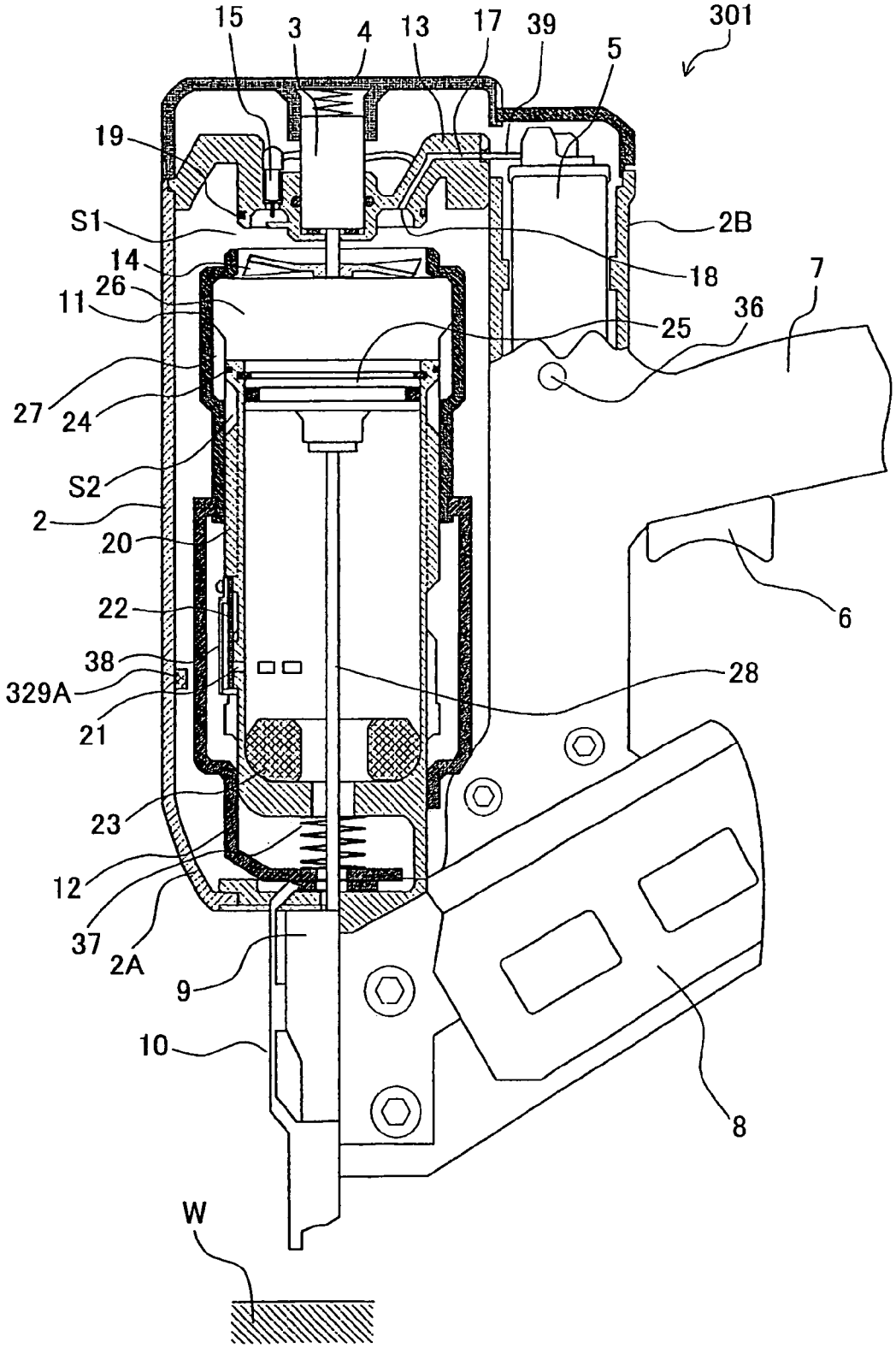
FIG. 6 is a vertical cross-sectional view showing a combustion type nail driver according to a fourth embodiment of a combustion type power tool of the present invention.

A combustion type nail driver according to a fourth embodiment will next be described with reference to FIG. 6. As shown in FIG. 6, fundamental construction and function of a combustion type nail driver 301 according to the fourth embodiment are the same as those of the first embodiment, and therefore, duplicating description will be omitted.

As shown in FIG. 6, in the nail driver 301, a temperature sensor 329A is provided at the main housing 2A for detecting a wall temperature thereof. Based on the temperature detection, nail driving operation of the nail driver 301 is controlled in a manner similar to the control made by the arrangement shown in FIG. 2.

A predetermined allowable temperature is set as to the surface temperature of the main housing 2A. Similar to the first embodiment, the temperature switch control circuit 45 outputs H level signal if the temperature sensor 329A detects the temperature not more than the allowable temperature, and outputs L level signal if the temperature sensor 329A detects the temperature exceeding the allowable temperature.

Generally, the housing is made from a plastic resin, whose heat resistance is lower than that of the cylinder 20 and the combustion chamber frame 11. Since the exhaust cover 38 whose temperature would be the highest among components of the tool 301 is disposed nearby the main housing 2A, the main housing 2A is exposed to heat released from the exhaust cover 38 and may be thermally melted or softened. If the main housing 2A is melted or softened, the tool 301 may be entirely distorted to lower the operation accuracy. To avoid this problem, the allowable temperature is determined to such a temperature at which melting of the main housing does not occur. Thus, the temperature switch control circuit can generate L level signal when the detected temperature exceeds the allowable temperature. Thus, combustion can be controlled in a manner similar to the first embodiment.

Figure 7:
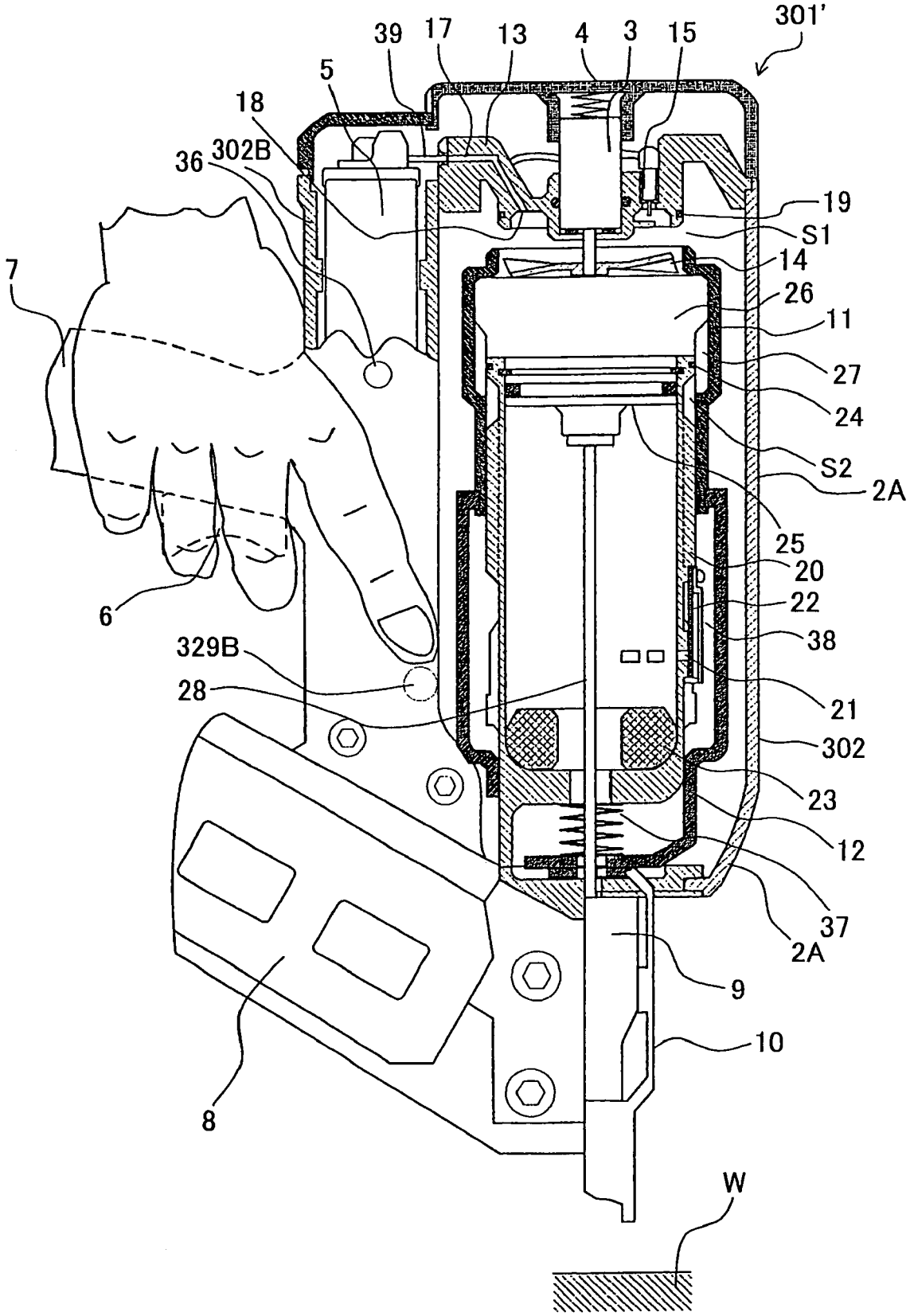
FIG. 7 is a vertical cross-sectional view showing a combustion type nail driver according to a modification to the fourth embodiment of a combustion type power tool of the present invention.

Alternatively, a temperature sensor 329B can be provided at the canister housing 302B which is a part of the housing 302 as shown in FIG. 7. The canister housing 302B and the handle 7 are parts to be held by a user's hand for holding an entire combustion type nail driver 301'. If the user holds the canister housing 302B whose temperature is not less than 45° C. for a prolonged period and, the hand may suffer from low temperature burn. To avoid this problem, the allowable temperature is determined to such temperature, and the temperature of the canister housing 302B is detected by the temperature sensor 329B. The temperature switch control circuit can generate L level signal when the temperature of the canister housing 302B exceeds the allowable temperature. Thus, combustion can be controlled in a manner similar to the first embodiment. The temperature sensor 329B can be provided at the handle 7 instead of the canister housing 302B.

Next, a combustion type nail driver according to a fifth embodiment of the present invention will be described with reference to FIGS. 8 to 9(*b*). Similar to the second embodiment, a temperature sensor 429 is attached to the outer peripheral surface of the cylinder 20.

Figure 8:
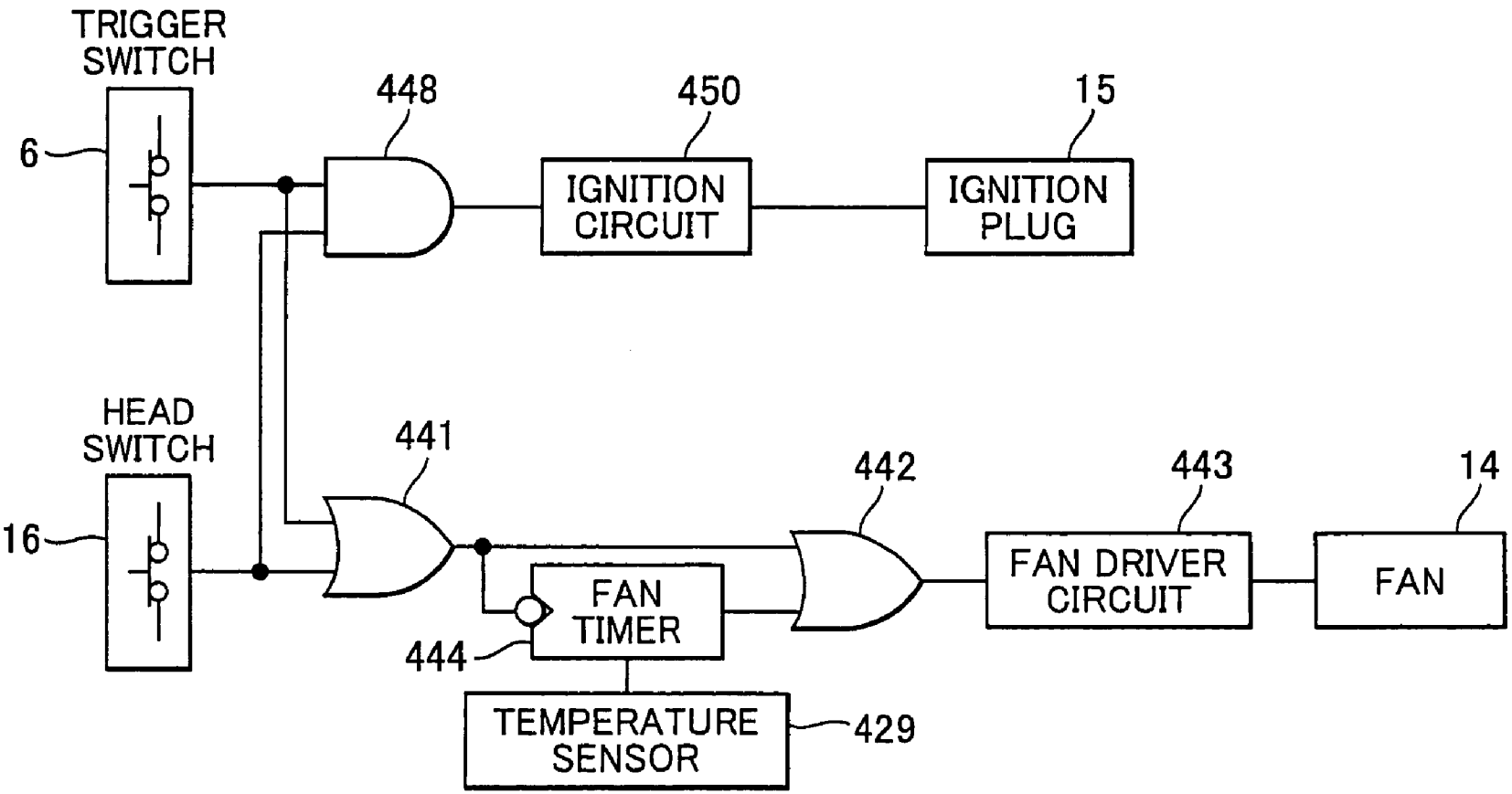
FIG. 8 is a block circuit diagram executing ON/OFF operation of a fan, and an ignition plug those being components of a combustion type nail driver according to a fifth embodiment of the present invention.
Figures 9A, 9B:
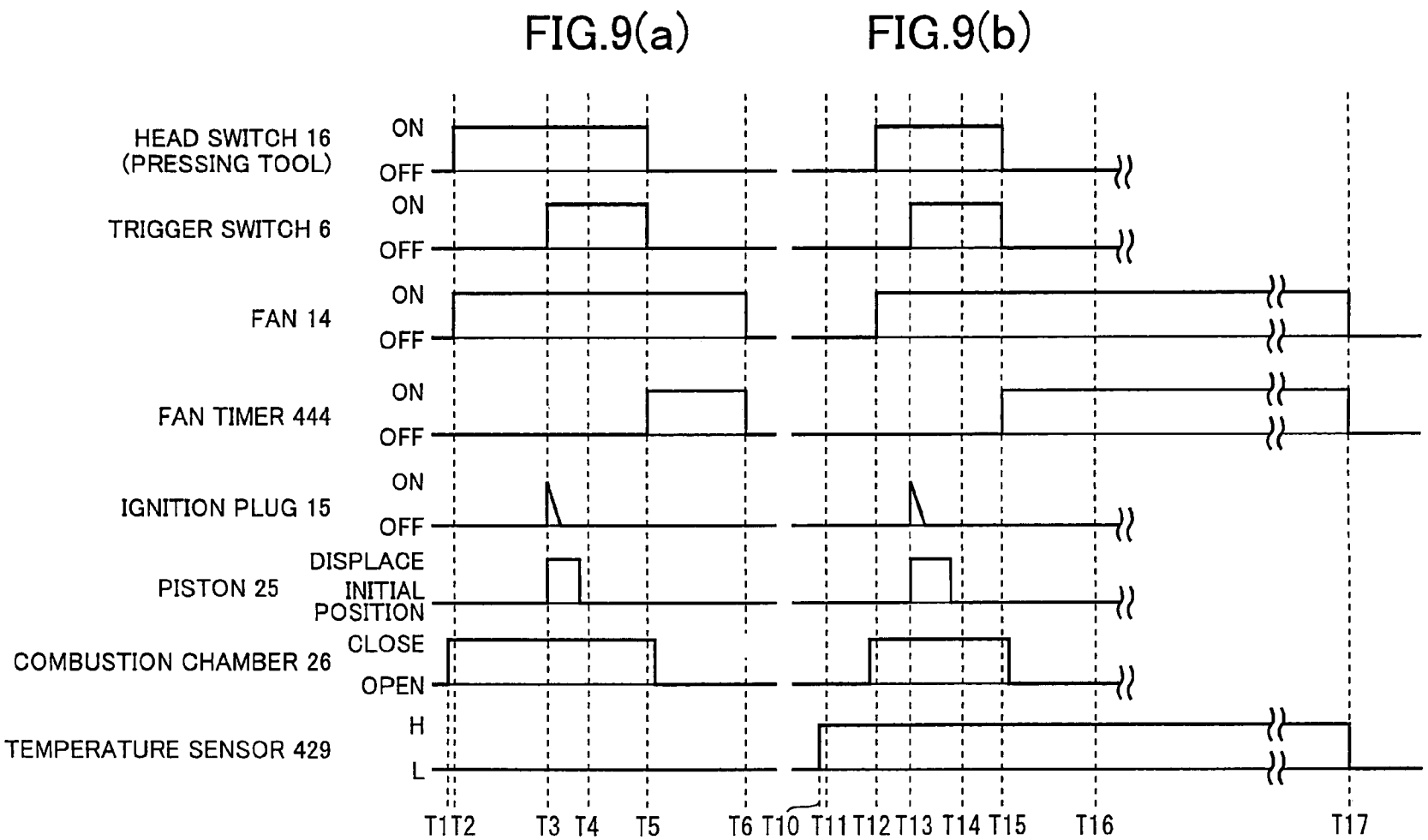
FIG. 9(*a*) is a timing chart for description of operational phases of the fan, the ignition plug, a piston, a combustion chamber, a fan timer and a temperature sensor in response to ON/OFF operation of a head switch and a trigger switch in the combustion type nail driver according to the fifth embodiment, and represents phases when temperature detected by a temperature sensor is not more than a preset temperature.

FIG. 8 shows a block circuit executing driving and non-driving to the fan 14 and ignition or non-ignition to the ignition plug 15 in the fifth embodiment. A first OR circuit 441 has two input terminals one being connected to the trigger switch 6 and the other being connected to the head switch 16. The first OR circuit 441 has an output terminal connected to a first input terminal of a second OR circuit 442. The second OR circuit 442 has an output terminal connected to a fan driver circuit 443 connected to the fan 14. Therefore, the operation of the fan driver circuit 443 starts for starting rotation of the motor 3 thereby starting rotation of the fan 14 in response to ON operation of at least one of the trigger switch 6 and the head switch 16.

A fan timer 444 is connected between the output terminal of the first OR circuit 441 and a second input terminal of the second OR circuit 442. The fan timer 444 starts to provide H level state when the trigger switch 6 and the head switch 16 are turned OFF, and then provides L level state after elapse of a predetermined time period from the timer start timing so as to stop rotation of the fan 14. Therefore, the fan driver circuit 443 is operated through the second OR circuit 442 as long as the fan timer 444 is in H level state so as to maintain rotation of the fan 14 unless the trigger switch 6 and the head switch 16 are turned OFF.

The temperature sensor 429 is connected to the fan timer 444. The temperature sensor 429 is adapted to output, to the fan timer 444, L level signal when the temperature of the cylinder 20 is not more than a predetermined temperature and H level signal when the temperature of the cylinder 20 exceeds the predetermined temperature. The predetermined temperature implies the maximum temperature which does not cause thermal deformation or damage to the seal members 19 and 24 made from rubber.

Here, the fan timer 444 maintains H level state as long as H level signal is input from the temperature sensor 429 so as to continue rotation of the fan 14. The temperature sensor 429 starts temperature detection when at least one of the trigger switch 6 and the head switch 16 is turned ON.

An AND circuit 448 has two input terminals one being connected to the trigger switch 6 and the other being connected to the head switch 16. The AND circuit 448 has an output terminal connected to an ignition circuit 450 connected to the ignition plug 15. With this arrangement, a driving signal is output to the ignition circuit 450 from the AND circuit 448 only when both the trigger switch 6 and the head switch 16 are ON states to ignite the ignition plug 15.

Operation of the combustion type nail driver according to the fifth embodiment will next be described with reference to a timing chart shown in FIGS. 9(*a*) and 9(*b*). The operational timings from T1 to T6 in FIG. 9(*a*) correspond to the timings from t1 to t6, respectively in FIG. 3(*a*). After elapse of predetermined time period, rotation of the fan 14 is stopped (T6) and the tool restores its initial rest state.

If the above-described nail driving operation is repeatedly performed, temperature of the combustion chamber frame 11 and the cylinder 20 are elevated. If the temperature of the cylinder 20 exceeds the predetermined allowable temperature (T10), operation timings T11 through T15 correspond respectively to the operation timings T1 through T5 regarding ON/OFF timing of the head switch 16, ON/OFF timing of the trigger switch 6, and opening/closing timing of the combustion chamber 26. On the other hand, the temperature sensor 429 continues output of H level signal to the fan timer 444 to nullify the timer function (from T5 to T6) of the fan timer 444. Therefore, the fan 14 continues rotation at a rotation speed of 12,000 rpm under the application of 7.2 volt to the motor through the second OR circuit 442 and the fan driver circuit 443. The rotation of the fan 14 is continued until the temperature sensor 429 outputs L level signal (T17) as a result of sufficient cooling to the cylinder 20. When the temperature sensor 429 detects the temperature not more than the predetermined temperature (T17), operation of the fan timer 444 is stopped to restore normal operational condition (operable at the duration of T5–T6).

In the above described control circuit, since rotation of the fan only continues when the temperature of the cylinder exceeds the predetermined temperature and the continuous rotation of the fan is stopped when the temperature becomes not more than the predetermined temperature, power consumption of the battery can be reduced in comparison with a case in which the fan is continuously rotated so as to continuously restrain the increase in temperature to the temperature below the predetermined temperature.

Figure 10:
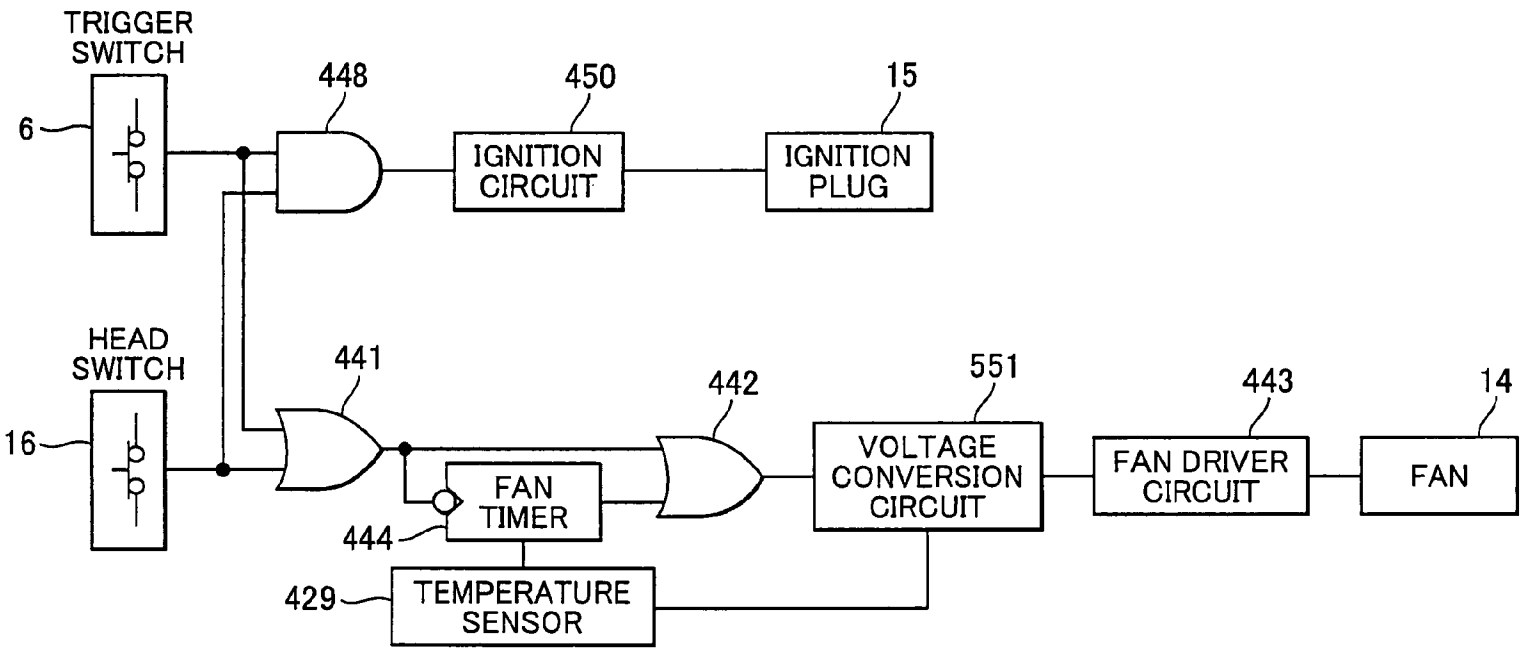
FIG. 10 is a block circuit diagram executing ON/OFF operation of a fan, and an ignition plug those being components of a combustion type nail driver according to a sixth embodiment of the present invention.

FIG. 10 shows a block circuit executing driving and non-driving to the fan 14 and ignition or non-ignition to the ignition plug 15 in a combustion type nail driver according to a sixth embodiment of the present invention. In FIG. 10, like parts and components are designated by the same reference numerals as those of the control circuit shown in FIG. 8 for eliminating duplicating description. The sixth embodiment installs 9.6 volts battery in the handle 7. In the control circuit shown in FIG. 10, a voltage conversion circuit 551 is connected between the output terminal of the second OR circuit 442 and the fan driver circuit 443, and is connected also to the temperature sensor 429. The voltage conversion circuit 551 rotates the fan 14 at a normal rotation speed of 12,000 rpm with the application voltage of 7.2 volts when the temperature of the wall of the cylinder 20 is not more than the predetermined temperature. On the other hand, the voltage conversion circuit 551 rotates the fan 14 at a high speed of not less than 15,000 rpm with the application voltage of 9.6 volts in order to promote cooling when the temperature of the wall of the cylinder 20 exceeds the predetermined temperature until the temperature of the cylinder becomes not more than the predetermined temperature. The relation between the temperature sensor 429 and the fan timer 444 is the same as that of the fifth embodiment. If the temperature sensor 429 detects the temperature not more than the predetermined temperature, operation of the fan timer 444 is stopped, and the voltage conversion circuit 551 restores its initial operational phase capable of rotating the fan at 12,000 rpm with the application voltage of 7.2 volts.

While the invention has been described in detail and with reference to specific embodiments thereof, it would be apparent to those skilled in the art that various changes and modification may be made therein without departing from the scope of the invention defined in claims.

For example, in the above-described embodiments, combustion is controlled on a basis of a temperature of a single component such as the combustion chamber frame and the housing. However, combustion control can be performed on a basis of temperatures of a plurality of components. For example, in the first embodiment, not only the temperature of the combustion chamber frame 11 but also the temperature of the gripping portion such as the gas canister housing 2B are detected for complementary temperature detection or performing complementary control. Alternatively, allowable temperatures are provisionally determined with respect to the combustion chamber frame 11, cylinder 20, exhaust cover 38 and the housing 2. If one of the components firstly reaches its allowable temperature, then temperature of remaining one of the components is detected so as to generate L or H level signal from the temperature switch control circuit.

Further, in the above-described embodiment, ON/OFF operation to the trigger switch 6 is performed for each nail driving operation. However, the embodiment can be applied to a continuous type nail driver in which pressing and release of the push lever 10 with respect to the workpiece W are repeatedly performed while the trigger switch 6 is maintained ON so as to perform nail driving operations to the various different locations of the workpiece W. Even in the latter case, according to the block diagrams shown in FIGS. 2, 8 and 10 rotation of the fan 14 can start upon turning ON either head switch 16 or the trigger switch 6, and the fan timer 44 can start upon turning OFF the head switch 16 and the trigger switch 6.

Further, according to the first through fourth embodiments, the location of the display 36 is not limited to the gas canister housing 2B. The display 36 can be located at the main housing 2A or the handle 7. Furthermore, as the display 36, other light source and a sound generator such as a buzzer are also available instead of LED. Further, in the first embodiment, igniting operation is prohibited when the detected temperature exceeds the preset temperature. As a modification, in addition to the ignition prohibiting operation, the fan 14 can be continuously rotated as long as the temperature exceeds the preset temperature for forcible cooling. This prompts to lower the temperature below the preset temperature to shorten the prohibiting period. Consequently, the nail driver can be efficiently used. To this effect, the output from the temperature sensor 29 is simply directed to the input of the OR circuit 42 by way of a NOT circuit.

Further, in the first through fourth embodiments, ignition is prohibited when the detected temperature exceeds a predetermined temperature. As a modification, in addition to the ignition prohibiting operation, the fan 14 can be continuously rotated as long as the temperature exceeds the preset temperature for forcible cooling. That is, an inventive concept based on the first through fourth embodiment can be combined with an inventive concept based on the fifth and sixth embodiments. This prompts to lower the temperature below the preset temperature to shorten the prohibiting period. Consequently, the nail driver can be efficiently used. To this effect, the output from the temperature sensor 29 is simply directed to the input of the OR circuit 42 by way of a NOT circuit.

Further, in the first through fourth embodiments, only the ignition is prohibited based on the temperature increase. Here, if each time the trigger switch 6 and the push lever 10 are operated while prohibiting the ignition, a combustible gas is ejected into the combustion chamber 26, and the combustible gas is exhausted to the atmosphere in vain. In order to avoid the waste of the combustible gas, a locking mechanism for locking the push lever 10 can be provided which prohibits pushing of the push lever 10 while the ignition is prohibited. To this effect, a solenoid can be provided which is operated under the control of the temperature switch control circuit 45 for directly fixing the push lever 10 at a given position, or for fixing the coupling member 12 connected to the push lever 10. Alternatively, a shape memory alloy or a bimetal can be used as a segment of the locking mechanism or as a material of the push lever and/or the coupling member without intervening the temperature switch control circuit 45. The segment can alter its shape dependent on the specific ambient temperature so as to lock the push lever 10 or the coupling member 12 connected to the push lever 10.

Further, in the above-described embodiments, one of the thermistor, thermo couple, and bimetal is used as the temperature sensor 29, and ignition control is performed through the temperature switch control circuit 45 based on the temperature detected by the temperature sensor 29. However, the thermo couple and the bimetal can be used as a switch which directly shuts off the operation of the ignition circuit. With this arrangement, the temperature switch control circuit 45 can be dispensed with to simplify the control circuit at a low cost. Furthermore, the temperature sensor 29 and the temperature switch control circuit 45 can be replaced by a bimetal and the shape memory alloy. This can further simplify the control circuit to provide a compact tool at a low cost.

Further, in the fifth and sixth embodiments, the temperature sensor 429 is disposed at the outer peripheral surface of the cylinder 20. However, the temperature sensor can be disposed at an outer peripheral surface of the combustion chamber frame 11 so as to detect the temperature thereof. Alternatively, the temperature sensor can be disposed at any position other than the cylinder 20 and the combustion chamber frame 11 as long as the position can assume the temperature of the combustion chamber 26.

Further, in the fifth and sixth embodiments, nail driving operation is still achievable even after the temperature sensor 429 detects the temperature exceeding the predetermined temperature. However, the fifth and sixth embodiments can provide additional function such that the nail driving operation can be suspended until the temperature becomes not more than the predetermined temperature. Furthermore, in FIGS. 8 and 10, the trigger switch 6 and the head switch 16 can be replaced from each other.

What is claimed is:

1. A combustion-type power tool comprising:

a housing having an inside, one end, and a lower side;

a handle extending from the housing and provided with a trigger switch;

a head section closing the one end of the housing and formed with a combustible gas passage;

a motor attached to the head section;

a push lever provided to the lower side of the housing and movable upon pushing onto a workpiece;

a cylinder secured to the inside of the housing and formed with an exhaust hole;

a piston slidably disposed in the cylinder and reciprocally movable in an axial direction of the cylinder;

a combustion-chamber frame provided in the housing and guidedly movable along the cylinder, the combustion-chamber frame having one end abuttable on and separable from the head section in interlocking relation to the movement of the push lever, a combination of the head section, the cylinder, the piston and the combustion-chamber frame defining a combustion chamber;

a driver blade extending from the piston toward a side opposite to the combustion chamber;

seal portions providing sealing relations between the combustion chamber frame and the head section and between the combustion chamber frame and the cylinder when the combustion chamber frame is brought into abutment with the head section;

a fan rotatably positioned in the combustion chamber and connected to the motor;

an ignition plug exposed to the combustion chamber for igniting a mixture of air and the combustible gas in the combustion chamber in response to operation of one of the trigger switch and the head switch;

an exhaust check valve selectively opening the exhaust hole, the combustible gas being supplied into the combustion chamber through a combustible gas passage, and being explodingly combusted upon ignition of the ignition plug for moving the piston;

a temperature detecting unit detecting a temperature associated with one of the housing and the handle; and an avoiding unit that avoids overheating to one of the housing, the handle, and components in the housing, the avoiding unit being connected to the temperature detecting unit for controlling operation of one of the ignition plug and the fan based on a temperature detected by the temperature detecting unit.

2. The combustion-type power tool as claimed in claim 1, wherein the avoiding unit comprises prohibiting means that prohibits ignition of the ignition plug when the temperature detected by the temperature detecting unit exceeds a predetermined temperature.

3. The combustion-type power tool as claimed in claim 2, wherein the temperature detecting unit is disposed at the combustion chamber frame.

4. The combustion-type power tool as claimed in claim 2, wherein the temperature detecting unit is disposed at the cylinder.

5. The combustion-type power tool as claimed in claim 2, wherein one of the components in the housing comprises an exhaust cover covering the exhaust check valve for changing a exhausting direction into an axial direction of the housing, the temperature detecting unit being disposed at the exhaust cover.

6. The combustion-type power tool as claimed in claim 2, wherein the temperature detecting unit is disposed at a wall of the housing.

7. The combustion-type power tool as claimed in claim 2, further comprising alarm means disposed at one of the housing and the handle for alarming that the temperature detected by the temperature detecting unit exceeds the predetermined temperature.

8. The combustion-type power tool as claimed in claim 1, wherein the avoiding unit controls operation of the fan based upon the temperature detected by the temperature detecting unit.

9. The combustion-type power tool as claimed in claim 1, wherein the avoiding unit controls operation of the ignition plug based on the temperature detected by the temperature detecting unit.

10. The combustion-type power tool as claimed in claim 1, wherein the avoiding unit controls operation of one of the ignition plug and the fan based on the temperature detected by the temperature detecting unit so as to at least avoid thermal damage to the seal portions.

11. The combustion-type power tool, comprising:

a housing having an inside, one end, and a lower side;

a handle extending from the housing and provided with a trigger switch;

a head section closing the one end of the housing and formed with a combustible gas passage;

a motor attached to the head section;

a push lever provided to the lower side of the housing and movable upon pushing onto a workpiece;

a cylinder secured to the inside of the housing and formed with an exhaust hole;

a piston slidably disposed in the cylinder and reciprocally movable in an axial direction of the cylinder;

a combustion-chamber frame provided in the housing and guidedly movable along the cylinder, the combustion-chamber frame having one end abuttable on and separable from the head section in interlocking relation to the movement of the push lever, a combination of the head section, the cylinder, the piston and the combustion-chamber frame defining a combustion chamber;

a driver blade extending from the piston toward a side opposite to the combustion chamber;

seal portions providing sealing relations between the combustion chamber frame and the head section and between the combustion chamber frame and the cylinder when the combustion chamber frame is brought into abutment with the head section;

a fan rotatably positioned in the combustion chamber and connected to the motor;

an ignition plug exposed to the combustion chamber for igniting a mixture of air and the combustible gas in the combustion chamber in response to operation of one of the trigger switch and the head switch;

an exhaust check valve selectively opening the exhaust hole, the combustible gas being supplied into the combustion chamber through a combustible gas passage, and being explodingly combusted upon ignition of the ignition plug for moving the piston;

a temperature detecting unit detecting a temperature associated with one of the housing and the handle; and an avoiding unit that avoids overheating to one of the housing, the handle, and components in the housing, the avoiding unit being connected to the temperature detecting unit for controlling operation of one of the ignition plug and the fan based on a temperature detected by the temperature detecting unit;

wherein the avoiding unit comprises prohibiting means that prohibits ignition of the ignition plug when the temperature detected by the temperature detecting unit exceeds a predetermined temperature; and wherein the avoiding unit further comprises a cooling control unit that controls rotation of the motor when the temperature detected by the temperature detecting unit exceeds the predetermined temperature so as to rotate the fan until the temperature detected by the detecting unit becomes not more than the predetermined temperature.

12. The combustion-type power tool comprising:

a housing having an inside, one end, and a lower side;

a handle extending from the housing and provided with a trigger switch;

a head section closing the one end of the housing and formed with a combustible gas passage;

a motor attached to the head section;

a push lever provided to the lower side of the housing and movable upon pushing onto a workpiece;

a cylinder secured to the inside of the housing and formed with an exhaust hole;

a piston slidably disposed in the cylinder and reciprocally movable in an axial direction of the cylinder;

a combustion-chamber frame provided in the housing and guidedly movable along the cylinder, the combustion-chamber frame having one end abuttable on and separable from the head section in interlocking relation to the movement of the push lever, a combination of the head section, the cylinder, the piston and the combustion-chamber frame defining a combustion chamber;

a driver blade extending from the piston toward a side opposite to the combustion chamber;

seal portions providing sealing relations between the combustion chamber frame and the head section and between the combustion chamber frame and the cylinder when the combustion chamber frame is brought into abutment with the head section;

a fan rotatably positioned in the combustion chamber and connected to the motor;

an ignition plug exposed to the combustion chamber for igniting a mixture of air and the combustible gas in the combustion chamber in response to operation of one of the trigger switch and the head switch;

an exhaust check valve selectively opening the exhaust hole, the combustible gas being supplied into the combustion chamber through a combustible gas passage, and being explodingly combusted upon ignition of the ignition plug for moving the piston;

a temperature detecting unit detecting a temperature associated with one of the housing and the handle; and an avoiding unit that avoids overheating to one of the housing, the handle, and components in the housing, the avoiding unit being connected to the temperature detecting unit for controlling operation of one of the ignition plug and the fan based on a temperature detected by the temperature detecting unit; and wherein the avoiding unit comprises prohibiting means that prohibits ignition of the ignition plug when the temperature detected by the temperature detecting unit exceeds a predetermined temperature; and wherein the avoiding unit comprises a cooling control unit that controls rotation of the motor when the temperature detected by the temperature detecting unit exceeds the predetermined temperature so as to rotate the fan until the temperature detected by the detecting unit becomes not more than the predetermined temperature.

13. The combustion-type power tool as claimed in claim 12, wherein the cooling control unit comprises a fan rotation continuing unit that continues rotation of the fan until the temperature detected by the detecting unit becomes not more than the predetermined temperature.

14. The combustion-type power tool as claimed in claim 12, wherein the cooling control unit comprises a fan rotation speed controller that controls rotation speed of the fan to a first rotation speed when the temperature detected by the detecting unit is not more than the predetermined temperature, and to a second rotation speed higher than the first rotation speed when the temperature detected by the detecting unit exceeds the predetermined temperature, the fan rotation speed controller maintaining the second rotation speed until the temperature detected by the detecting unit becomes not more than the predetermined temperature.

15. A combustion-type power tool comprising:

a housing defining an outer frame;

a combustion chamber provided in the housing;

a fan positioned in the combustion chamber;

a motor that drives the fan;

an ignition plug having an ignition point exposed to the combustion chamber;

a temperature detecting unit detecting a temperature of a target to be temperature-detected; and an avoiding unit that avoids overheating to the target, the avoiding unit controlling operation of one of the ignition plug and the motor based on a temperature detected by he temperature detecting unit.

16. The combustion-type power tool as claimed in claim 15, wherein the target to be temperature-detected is a part associated with the combustion-type power tool.

17. The combustion-type power tool as claimed in claim 16, wherein the part is at least one of the housing and a handle of the combustion type power tool.

18. The combustion-type power tool as claimed in claim 15, wherein the avoiding unit controls operation of the motor based upon the temperature detected by the temperature detecting unit.

19. The combustion-type power tool as claimed in claim 15, wherein the avoiding unit controls operation of the ignition plug based on the temperature detected by the temperature detecting unit.

20. The combustion-type power tool as claimed in claim 15, wherein the avoiding unit controls operation of one of the ignition plug and the motor based on the temperature detected by the temperature detecting unit so as to at least avoid thermal damage to seal portions of the combustion-type power tool.

* * * * *